US009989907B2

(12) United States Patent
Sakai

(10) Patent No.: US 9,989,907 B2
(45) Date of Patent: Jun. 5, 2018

(54) IMAGE INFORMATION APPARATUS

(71) Applicant: CANON KABUSHIKI KAISHA, Tokyo (JP)

(72) Inventor: Masayuki Sakai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/637,058

(22) Filed: Jun. 29, 2017

(65) Prior Publication Data

US 2018/0011433 A1 Jan. 11, 2018

(30) Foreign Application Priority Data

Jul. 5, 2016 (JP) ..... 2016-133562

(51) Int. Cl.
*G03G 15/20* (2006.01)
*G03G 15/00* (2006.01)

(52) U.S. Cl.
CPC ..... *G03G 15/2067* (2013.01); *G03G 15/2078* (2013.01); *G03G 15/2089* (2013.01); *G03G 15/657* (2013.01); *G03G 2215/2022* (2013.01); *G03G 2215/2038* (2013.01); *G03G 2215/2041* (2013.01)

(58) Field of Classification Search
CPC ..... G03G 15/2067; G03G 15/657; G03G 15/2078; G03G 2215/2041; G03G 15/2038
See application file for complete search history.

(56) References Cited

U.S. PATENT DOCUMENTS 5,016,057 A * 5/1991 Nakajima ..... G03G 15/2064 100/172
2009/0317118 A1* 12/2009 Sakai ..... G03G 15/5004 399/75
2012/0195607 A1* 8/2012 Inoue ..... G03G 15/5008 399/38
2013/0320608 A1* 12/2013 Tokoro ..... B65H 5/068 271/3.2
2017/0285536 A1* 10/2017 Kato ..... G03G 15/205

FOREIGN PATENT DOCUMENTS

JP 2002-169407 A 6/2002
JP 2002-366001 A 12/2002
JP 2007-264454 A 10/2007

* cited by examiner

*Primary Examiner* — G. M. Hyder
(74) *Attorney, Agent, or Firm* — Fitzpatrick, Cella, Harper & Scinto

(57) ABSTRACT

An image forming apparatus includes an image forming portion configured to form a developer image on a recording material, a fixing portion configured to heat-fix the developer image to the recording material, a first motor configured to drive the image forming portion, a second motor configured to drive the fixing portion, and a control portion configured to control the first motor and the second motor. The second motor is a stepping motor. The control portion allows the second motor to start rotation at a speed in a self-start region, temporarily stops the second motor at a timing at which the first motor is activated, then allows the second motor to restart rotation at a speed in the self-start region, and changes the speed of the second motor to a speed outside of the self-start region before the recording material arrives at the fixing portion.

7 Claims, 3 Drawing Sheets

IMAGE INFORMATION APPARATUS

Claim of Priority

This application claims the benefit of Japanese Patent Application No. 2016-133562, filed Jul. 5, 2016, which is hereby incorporated by reference herein in its entirety.

BACKGROUND OF THE INVENTION

Field of the Invention

The present invention relates to an image forming apparatus using an electrophotographic method.

Description of the Related Art

Image forming apparatuses such as printers, copiers, and printing apparatuses include, as a fixing portion, a fixing apparatus that applies heat and pressure to a recording material electrostatically carrying toner, while conveying the recording material, held in a sandwiching manner by a rotating member that is in rotation and in pressure contact with the recording material, to melt and to fix the toner onto the recording material.

A heating system for such a fixing apparatus includes a film, a belt, or the like, as the rotating member to heat a circumferentially partial area of the inside of the rotating member (see, for example, Japanese Patent Application Laid-open No. 2002-169407). In this system, a heating member has a small heat capacity, allowing a reduction in time needed to reach a fixation temperature (warm up time). Therefore, the system involves only a short time (a first print time) from the start of printing until the first recording material with an image formed thereon is discharged into a sheet discharging portion.

In the system heating a partial area of the rotating member, when the rotating member is heated with the rotating member stopped, a profound difference in temperature occurs between a heating area and a non-heating area. This may affect heat resistance and durability of a material used for the rotating member. When the rotating member is heated with the rotating member stopped and the rotating member is driven immediately before a fixing operation is started, temperature non-uniformity in the circumferential direction may result in non-uniform melting of the toner on the recording material. Therefore, to shorten the first print time, the system heating a partial area of the rotating member starts to heat the rotating member and to activate the rotating member, simultaneously with a start of a printing operation.

A second motor that is a driving source for the fixing rotating member may be configured differently from a first motor that is a driving source for a photosensitive member and an intermediate transfer member. In this configuration, to reduce the first print time, first, only the second motor is driven. Operation of the first motor need not be performed until a timing when image production needs to be started.

However, in the above-described image forming apparatus, on account of a short first print time, the fixing apparatus is heated, and the second motor is started simultaneously with a start of the printing operation. Naturally, activation of the first motor is started simultaneously with or later than activation of the second motor. As a result, a low-voltage power supply that is a power source for the second motor and the first motor supplies power to the first motor, while supplying power to the second motor. Therefore, power for the low-voltage power supply needs to be designed by adding activating peak power for the first motor to driving power for the second motor.

An object of the present invention is to provide a technique for reducing peak power used to drive a motor to enable a fixing portion to perform a stable warm up operation.

SUMMARY OF THE INVENTION

To accomplish this object, in one aspect, the present invention provides an image forming apparatus that includes an image forming portion configured to form a developer image on a recording material, a fixing portion configured to heat-fix the developer image to the recording material, a first motor configured to drive the image forming portion, a second motor configured to drive the fixing portion, and a control portion configured to control the first motor and the second motor, wherein the second motor is a stepping motor, and the control portion allows the second motor to start rotation at a speed in a self-start region, temporarily stops the second motor at a timing at which the first motor is activated, then allows the second motor to restart rotation at a speed in the self-start region, and changes the speed of the second motor to a speed outside of the self-start region before the recording material arrives at the fixing portion.

Further features of the present invention will become apparent from the following description of exemplary embodiments (with reference to the attached drawings).

DESCRIPTION OF THE EMBODIMENTS

Hereafter, a description will be given, with reference to the drawings, of embodiments (examples) of the present invention. However, the sizes, materials, shapes, their relative arrangements, or the like, of constituents described in the embodiments may be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Embodiment 1

The present invention is applicable to various image forming apparatuses, such as printers, copiers, and printing apparatuses, which are based on an electrophotograhic system. An image forming apparatus according to an embodiment of the present invention is a color laser printer based on an intermediate transfer belt.

Figure 1:
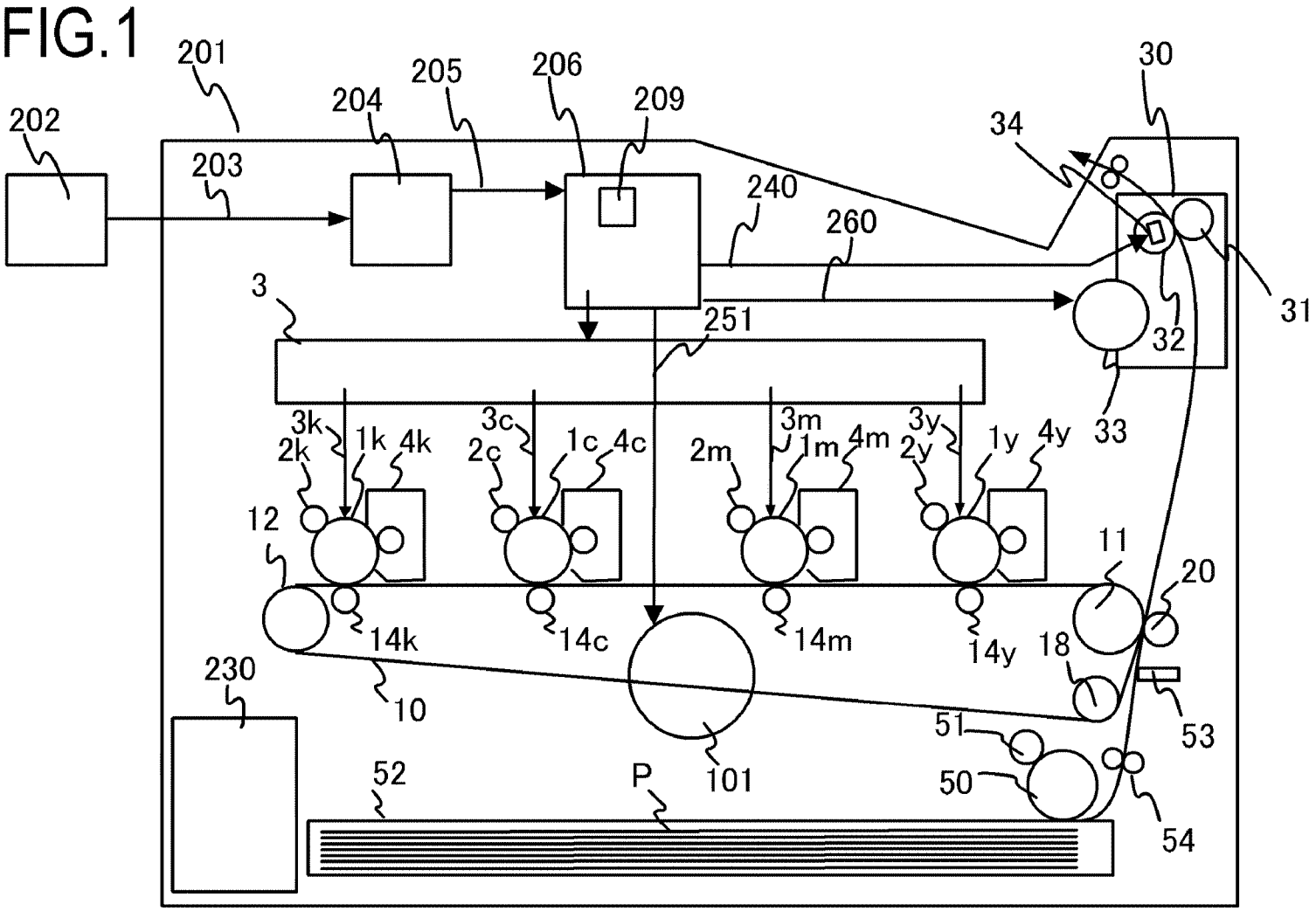
FIG. 1 is a diagram depicting an image forming apparatus in Embodiment 1 of the present invention.

A configuration and an operation of the image forming apparatus in the present embodiment will be described using FIG. 1. A color laser printer 201 (hereafter referred to as a printer 201) that is the image forming apparatus in the present embodiment includes a four-color image forming portion in order to form a color image by superimposing images in four colors (Y: yellow, M: magenta, C: cyan, and Bk: black) on one another. When the printer 201 receives an image data signal 203 from a host computer 202, a print image generating portion 204 in the printer 201 expands the image data signal 203 into a desired video signal format data to generate a video signal 205 for image formation. The generated video signal 205 is transmitted from the print image generating portion 204 to a control portion 206.

The control portion 206 has, for instance, a CPU 209 serving as a control portion that executes arithmetic processing and controls operation of each member of the apparatus, and a memory. Upon receiving the video signal 205, the control portion 206 allows image exposure means 3 to irradiate a drum-shaped electrophotograhic photosensitive member (hereafter referred to as a photosensitive drum) with image exposure light. The photosensitive drum includes photosensitive drums 1*y*, 1*m*, 1*c*, and 1*k* in four colors that are rotationally driven at a predetermined peripheral speed (process speed) by a first motor 101. The first motor 101 is controlled by a first motor ON signal 251 so as to operate at a target peripheral speed. The first motor 101 includes a brush motor that performs feedback control so as to achieve a target speed, or a brushless motor.

During rotation, the photosensitive drums 1*y*, 1*m*, 1*c*, and 1*k* are uniformly charged to predetermined polarities and potentials by charging rollers 2*y*, 2*m*, 2*c*, and 2*k* and then receive image exposure light 3*y*, 3*m*, 3*c*, and 3*k* by the image exposure means 3. This leads to formation of electrostatic latent images corresponding to color component images of a target color image. Then, the electrostatic latent images are developed by developers 4*y*, 4*m*, 4*c*, and 4*k* at development positions, and thus, visualized as toner images.

An intermediate transfer belt 10 is an endless belt stretched by stretching members (a drive roller 11, a tension roller 12, and an auxiliary roller 18). The intermediate transfer belt 10 has a contact portion that contacts the photosensitive drums 1*y* to 1*k* and is rotationally driven by the drive roller 11 at substantially the same peripheral speed as that at which the photosensitive drums 1*y* to 1*k* are rotationally driven. While passing through the contact regions between the intermediate transfer belt 10 and the photosensitive drums 1*y* to 1*k*, toner images formed on the photosensitive drums 1*y* to 1*k* are transferred onto the intermediate transfer belt 10 by primary transfer voltages applied to primary transfer rollers 14*y*, 14*m*, 14*c*, and 14*k*, respectively (primary transfer).

While passing through a secondary transfer nip between the intermediate transfer belt 10 and a secondary transfer roller 20, the toner image on the intermediate transfer belt 10, which serves as a developer image in four colors, is totally transferred (secondary transfer) to a surface of a recording material P at one time by a secondary transfer voltage applied to a secondary transfer roller 20. The recording material P is fed from a sheet cassette 52 by a sheet feeding roller 50. The sheet feeding roller 50 starts an operation of feeding the recording material P when a sheet-feeding electromagnetic clutch 51 is turned on to transmit rotation of the first motor 101 to the sheet feeding roller 50. The fed recording material P reaches a registration roller pair 54, and then, a registration sensor 53 is turned on. At this time, to align the toner image formed on the intermediate transfer belt 10 with the position of the sheet fed by the sheet feeding roller 50, the sheet-feeding electromagnetic clutch 51, which couples the first motor 101 and the sheet feeding roller 50 together, is turned on and off. The set of drive members described above is rotated by using the first motor 101 as a drive source. The above-described components involved in formation and placement of the four-color toner image on the recording material P (the toner image is unfixed) corresponds to an image forming portion.

Subsequently, the recording material P carrying the four-color toner image is introduced into a fixing apparatus 30 serving as a fixing portion. The fixing apparatus heats and pressurizes the recording material P to melt the four-color toner and to mix the colors together. The toner is thus fixed to the recording material. The above-described operations allow a full-color print image to be formed.

Now, operations of the fixing apparatus 30 will be described in detail. The fixing apparatus 30 includes, in a basic configuration thereof, a pressure contact roller pair of a heat roller 32 and a fixing roller 31 (pressure roller). The heat roller 32 is formed of a cylindrical film material and includes a heater 34 inserted and disposed inside the heat roller 32, and serving as a heat source. To keep an outer peripheral surface of the heater 34 at a predetermined fixation temperature, electrification of the heater 34 is controlled by a heater electrification signal 240 to regulate the temperature. The film of the heat roller 32 is configured to be in sliding contact with the heater 34, which contacts an inner surface of the heat roller 32. On the other hand, the heat roller 32 is driven by the fixing roller 31, which contacts an outer surface of the heat roller 32. Thus, the heat roller 32 rotates in conjunction with rotation of the fixing roller 31.

When the toner is fixed, the recording material P, on which the unfixed toner image to be fixed thereto eventually is formed and carried, is introduced into a fixing nip region that is a mutual pressure contact portion between the paired rollers. The recording material P is transported while being sandwiched between the rollers, such that the unfixed toner image is fixed in a thermocompressive manner to the recording material P by heat from the heat roller 32 and a pressurizing force exerted in the fixing nip region. The fixing roller 31 is rotated using, as a drive source, a stepping motor (second motor) 33 that can rotate at a pulse rate in a self-start region (for example, 0 to 600 pps (pulses per second), the rate depending on the specifications of the motor). The self-start region of the stepping motor 33 means a frequency region where the stepping motor 33 can be instantaneously started and stopped and rotated forward and backward in synchronism with a pulse signal externally input to the stepping motor 33. The self-start region indicates a general basic characteristic of the stepping motor 33.

A low-voltage power supply 230 is a power source for the first motor 101, the second motor 33, which is a drive source for the fixing apparatus 30, and the heater 34, and regulates power supplied by a commercial power supply located outside of the image forming apparatus to supply the regulated power to the above-described members. The motors, and the like, are supplied with power by the low-voltage power supply 230.

<Method of Driving Control at the Start of Printing>

Figure 2:
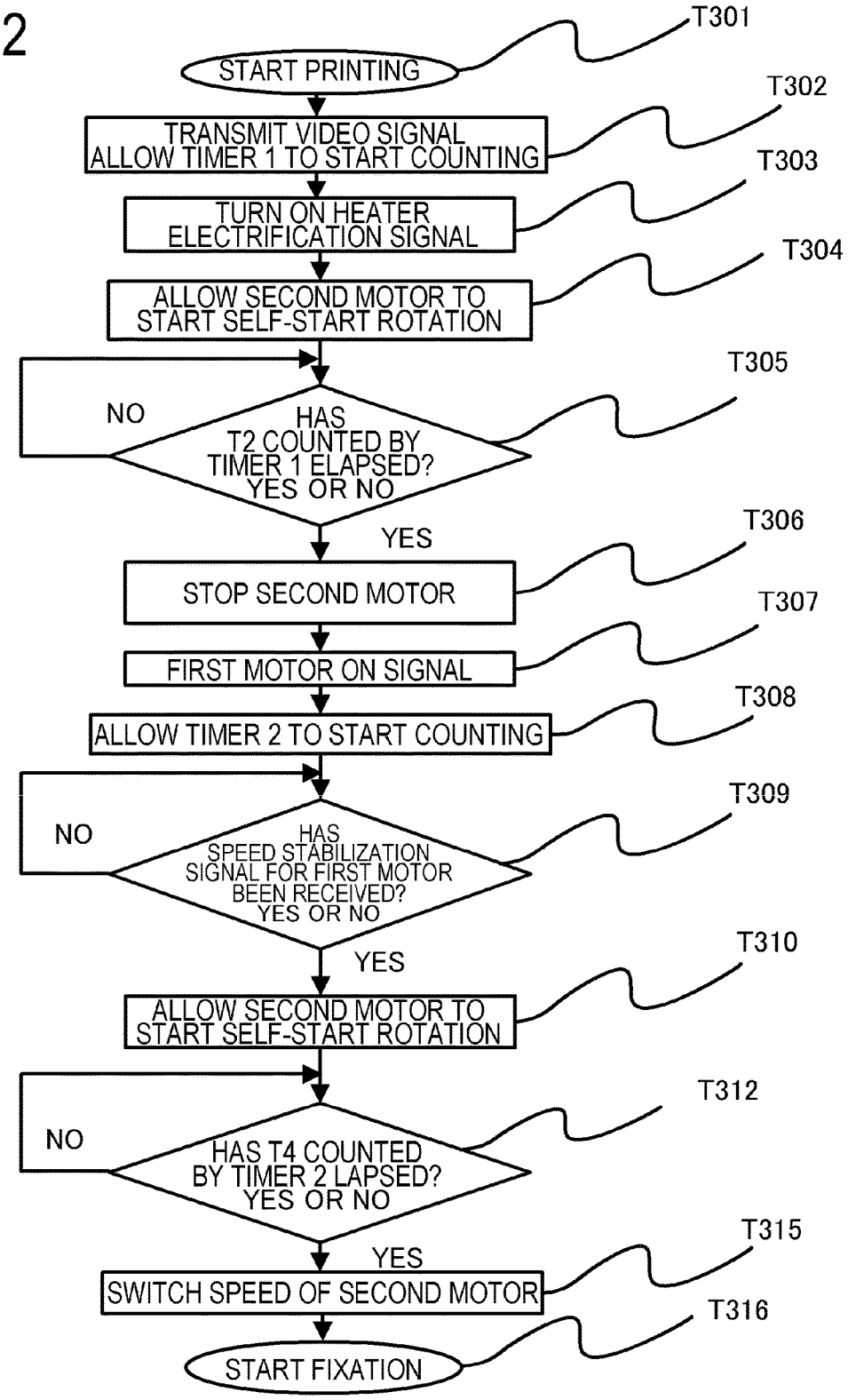
FIG. 2 is a flowchart illustrating a driving control method in Embodiment 1 of the present invention.

Drive control performed at the start of printing in the present invention will be described using a flowchart shown in FIG. 2. First, the host computer 202 transmits the image data signal 203 to the print image generating portion 204 <T301>. Then, the print image generating portion 204 transmits the video signal 205 to the control portion 206 and allows a timer 1 to start counting <T302>. The control portion 206 transmits an ON signal for the heater electrification signal 240 <T303>. Then, the second motor starts self-start rotation (for example, at 300 pps) <T304>.

The control portion 206 allows the timer 1 to start counting at the time of reception of the video signal, and when a predetermined time T2 elapses <T305>, stops the second motor 33 <T306>. Then, to perform image production, the first motor ON signal 251 is transmitted <T307>. A time T2 is set such that the recording material P arrives at the fixing apparatus 30 after the heat roller 32 reaches a temperature at which sufficient fixation can be achieved. The time T2 is determined by subtracting the time from the start of driving of the first motor 101 until the recording material P arrives at the fixing apparatus 30, from the time from turn-on of heater electrification until the heat roller 32 reaches the temperature at which fixation can be achieved. For the time T2, a value varied according to the type of sheets is stored in (a memory of) the control portion 206.

The control portion 206 transmits the first motor ON signal <T307> and allows a timer 2 to start counting <T308>. Then, the control portion 206 determines whether the first motor 101 has reached a target speed, based on a speed stabilization signal generated through feedback control of the first motor 101 <T309>. When the control portion 206 receives the speed stabilization signal relating to the first motor 101, the second motor 33 restarts the self-start rotation <T310>.

An operation of feeding the recording material P is started when the sheet feeding roller 50 starts to rotate in conjunction with turn-on of the sheet-feeding electromagnetic clutch 51 after the first motor speed ON signal is transmitted <T307>. The control portion 206 uses the timer 2 to count a time T4 shorter than the time from driving of the first motor 101 until the recording material P arrives at the fixing apparatus 30 <T312>. When the time T4, counted by the timer 2, elapses, the control portion 206 switches the speed of the second motor 33 (for example, 300 pps to 1,000 pps) <T315>. The speed is increased and reduced by increasing and reducing a clock frequency of the CPU 209.

The control portion 206 starts fixation <T316> after switching the speed of the second motor 33 <T315>. The speed of the second motor 33 is switched to set a fixation speed so as to allow smooth transport of the recording material P, which arrives at the fixing apparatus 30 after passing through the secondary transfer nip.

How a drive current flows through the low-voltage power supply 230 in accordance with the flowchart shown in FIG. 2 will be described using a timing chart in FIG. 3. The control portion 206 receives the video signal 205 <T302>. The control portion 206 immediately transmits the ON signal for the heater electrification signal 240 <T303> and allows the second motor 33 to start self-start rotation <T304>. Therefore, a current allowing the second motor 33 to perform self-start rotation flows through the low-voltage power supply 230.

After the predetermined time T2 elapses <T305>, the control portion 206 stops the second motor 33 in order to perform image production <T306>. The control portion 206 transmits an ON signal 251 for the first motor 101 <T307>. Therefore, only the activation current for the first motor 101 flows through the low-voltage power supply 230, allowing summation of the activation current for the first motor 101 and a current for the second motor 33 to be avoided. Since the second motor 33 is driven at the pulse rate (300 pps) in the self-start region (0 to 600 pps), the second motor 33 can be instantaneously stopped without the need for a fall time for the speed.

Then, the control portion 206 determines whether the first motor 101 has reached the target speed based on the speed stabilization signal for the first motor 101 <T309>. The control portion 206 then allows the second motor 33 to start the self-start rotation (300 pps) <T310>. Therefore, the second motor 33 needs to be stopped only for a short time while the first motor 101 is being started up, allowing avoidance of temperature non-uniformity in a circumferential direction of the heat roller 32.

After the first motor ON signal 251 is transmitted <T306>, the time T4 is counted <T312>. When the time T4 elapses, the speed of the second motor 33 is switched to the fixation speed (1,000 pps) <T315>, and fixation is started <T316>.

Figure 3:
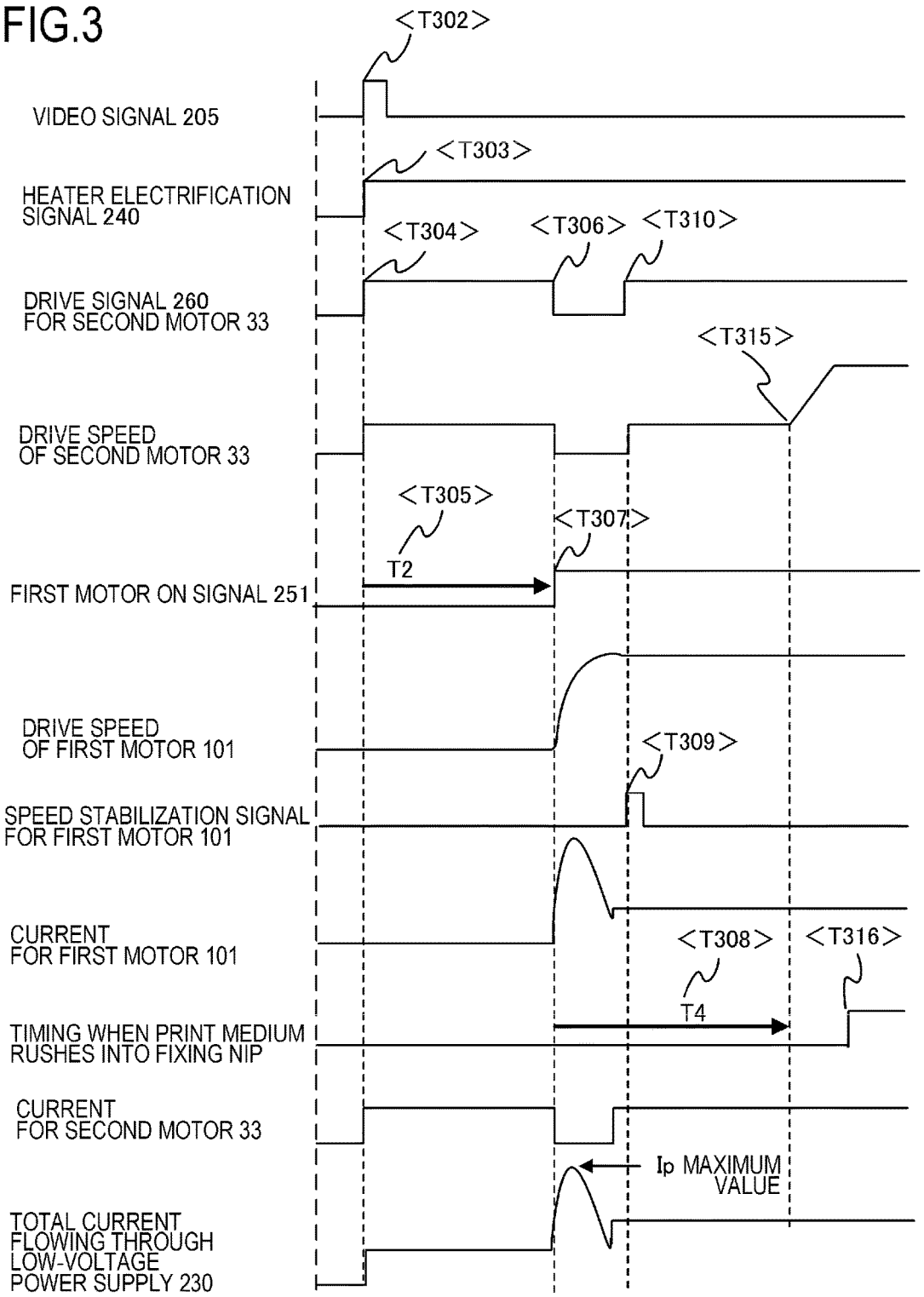
FIG. 3 is a flowchart illustrating the driving control method in Embodiment 1 of the present invention.

The use of the above-described control makes a maximum drive current value Ip indicated as the sum current flowing through the low-voltage power supply 230 in FIG. 3 only equal to the activation current value for the first motor 101, eliminating the need to add the drive current for the second motor 33. The second motor 33 rotates in the self-start region, and can thus be instantaneously stopped and activated, eliminating the need for a rise time for the speed. Therefore, the need for the time to allow the second motor to be operated at a given speed is eliminated, enabling a reduction in the time for which the heat roller 32 is stopped. This allows avoidance of disadvantageous temperature non-uniformity resulting from a non-uniform speed of the heat roller 32.

A warm-up operation of the fixing apparatus 30 may be started before a timing when the image data signal is received from the host computer. For example, if the host computer sends a print preparation signal before transmitting the image data signal, the second motor 33 may start rotation in the self-start region at a timing when the print preparation signal is received.

As described above, in the present embodiment, first, the second motor is allowed to start rotation at a speed in the self-start region and temporarily stopped at the timing when the first motor is activated. Then, after the first motor is stabilized at a predetermined speed, the temporary stoppage of the second motor is canceled, and the second motor is allowed to restart rotation at a speed in the self-start region. Before the recording material arrives at the fixing apparatus, the second motor is accelerated to a speed outside of the self-start region. The present embodiment reduces the first print time, thus enabling a reduction in peak power of the low-voltage power supply, while allowing the fixing apparatus to be activated first. Therefore, only the peak current for the first motor needs to be provided, though activation peak power for the first motor conventionally needs to be added to drive power for the second motor. Moreover, the second motor rotates in the self-start region and can be activated and stopped in a short time, allowing disadvantageous non-uniformity of the fixing temperature to be avoided.

During the warm-up operation and the actual heat fixing operation of the fixing apparatus 30, the pulse rate of the second motor 33 used to drive the fixing roller 31 is not limited to the above-described rate. The pulse rate outside of the self-start region for the heat fixing operation described in the present embodiment is, for example, a pulse rate for heat fixation of plain paper. For example, for heat fixation of cardboard, the pulse rate may have a value inside the self-start region. Even if the pulse rate for the heat fixing operation does not have a value outside of the self-start region, effects such as a reduction in the peak power of the low-voltage power supply can, of course, be produced. However, the present invention is notably effective when the heat fixing operation involves a pulse rate outside of the self-start region.

The present invention allows a reduction in the peak power at which the motor is driven to enable the fixing portion to perform a stable warm-up operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming portion configured to form a developer image on a recording material;

a fixing portion configured to heat-fix the developer image to the recording material;

a first motor configured to drive the image forming portion;

a second motor configured to drive the fixing portion; and a control portion configured to control the first motor and the second motor, wherein the second motor is a stepping motor, and the control portion allows the second motor to start rotation at a speed in a self-start region, temporarily stops the second motor at a timing at which the first motor is activated, then allows the second motor to restart rotation at a speed in the self-start region, and changes the speed of the second motor to a speed outside of the self-start region before the recording material arrives at the fixing portion.

2. The image forming apparatus according to claim 1, wherein, after the first motor is stabilized at a predetermined speed, the control portion cancels temporary stoppage of the second motor and allows the second motor to restart rotation at a speed in the self-start region.

3. The image forming apparatus according to claim 1, wherein, upon receiving an image data signal from a host computer, the control portion allows the second motor to start rotation at a speed in the self-start region.

4. The image forming apparatus according to claim 1, wherein, upon receiving a print preparation signal sent from a host computer at a timing before transmission of the image data signal, the control portion allows the second motor to start rotation at a speed in the self-start region.

5. The image forming apparatus according to claim 1, wherein the fixing unit includes a tubular film, a heater in contact with an inner surface of the film, and a fixing roller configured to be rotatable and in contact with an outer surface of the film, and the second motor rotates the fixing roller to transport the recording material sandwiched between the fixing roller and the film, while the developer image formed on the recording material is heat-fixed by heat from the heater, and the heater continuously heats while the second motor is temporarily stopped.

6. The image forming apparatus according to claim 1, wherein the first motor is one of (i) a brush motor that enables feedback-control and (ii) a brushless motor.

7. The image forming apparatus according to claim 1, wherein the image forming portion includes at least a photosensitive member, and the first motor rotates the photosensitive member.

* * * * *